US006309044B1

(12) United States Patent
Gaarder

(10) Patent No.: US 6,309,044 B1
(45) Date of Patent: Oct. 30, 2001

(54) TWO STAGE PRINT CARTRIDGE CAPPING TECHNIQUE

(75) Inventor: Glenn W. Gaarder, Ramona, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/058,600

(22) Filed: Apr. 10, 1998

(51) Int. Cl.[7] ..... B41J 2/165
(52) U.S. Cl. ..... 347/32; 347/29
(58) Field of Search ..... 347/32, 29

(56) References Cited

U.S. PATENT DOCUMENTS

| | | | | |
|---|---|---|---|---|
| 5,155,497 | | 10/1992 | Martin et al. | 347/33 |
| 5,252,993 | | 10/1993 | Tomli | 347/32 |
| 5,790,148 | * | 8/1998 | Gavillet et al. | 347/29 |

FOREIGN PATENT DOCUMENTS 2 284 576 * 6/1995 (GB) .

OTHER PUBLICATIONS

EP 0 635 371 A, Hewlett–Packard Company, Jan. 25, 1995.
EP 0597 621 A, Xerox Corp, May 18, 1994.
EP 0 780 232 A, Hewlett Packard Co, Jun. 25, 1997.
WO 96 34754 A, Encad Inc., Nov. 7, 1996.
EP 0 480 302 A, Cannon KK, Apr. 15, 1992.
EP 0719 645 A, OCD SA, Jul. 3, 1996.
European Search Report dated Jul. 15, 1999 re European Patent Application 99302491.

* cited by examiner

*Primary Examiner*—Thinh Nguyen
*Assistant Examiner*—Shih-wen Hsieh

(57) ABSTRACT

A service station servicing an ink-jet printhead of an ink-jet printing system. The service station includes a sled structure, and an elevator mechanism coupled to the sled structure for moving the sled structure between a rest position and a sled capping position. A printhead cap is supported on the sled structure, and is movable relative to the sled structure for movement between a retracted position and a printhead capping position. The cap is adapted to surround and seal the printhead nozzles when the sled has been moved to the sled capping position and the printhead cap has been moved to the printhead capping position. A piston is carried by the sled structure, and the printhead cap is mounted to the piston. An actuating mechanism moves the piston from a retracted position to an extended position, wherein the printhead cap is positioned at the printhead capping position when the piston is moved to the extended position. The sled structure includes a set of sled datum structures adapted to mate with a corresponding set of datum features formed in a printhead carriage structure when the carriage structure is positioned at the service station as the sled structure is moved from the rest position to the sled capping position. The actuating mechanism is adapted to move the piston to the extended position after the sled structure has been moved from the rest position to the sled capping position.

18 Claims, 12 Drawing Sheets

FIG. 11
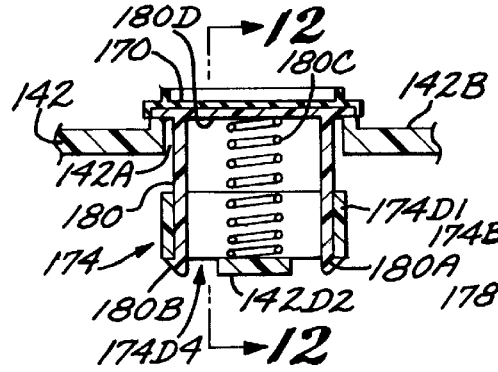
FIG. 12
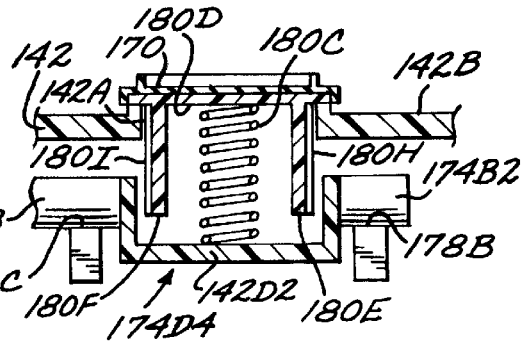
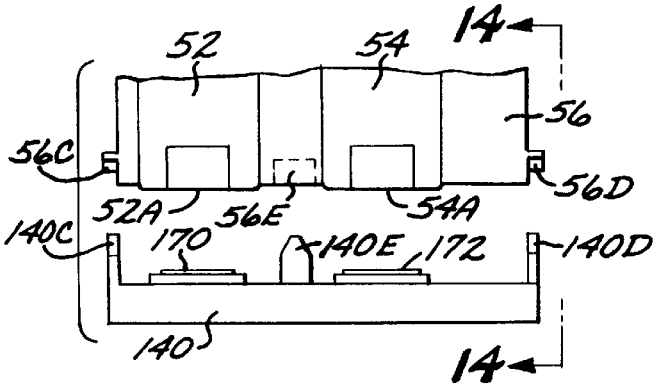
FIG. 13
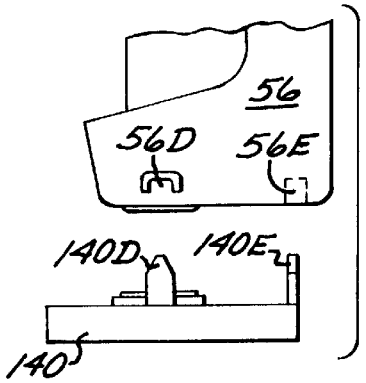
FIG. 14
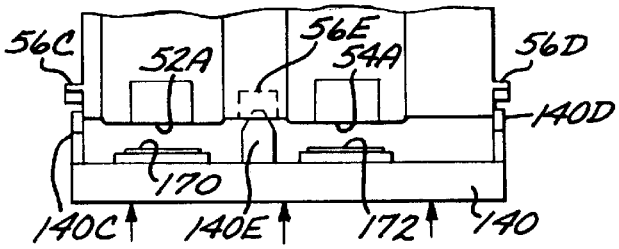
FIG. 15
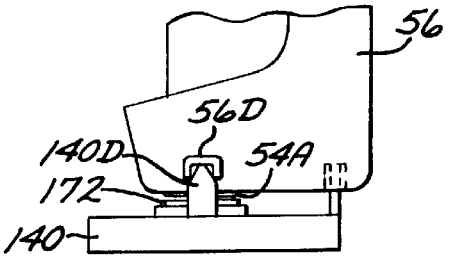
FIG. 17
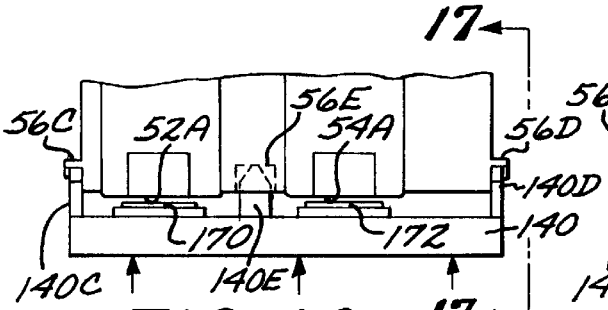
FIG. 16
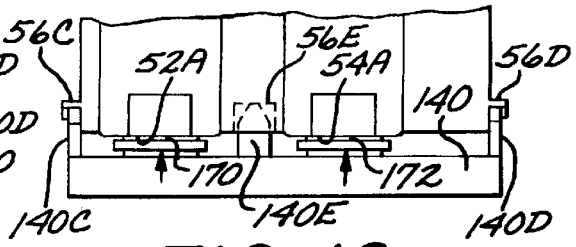
FIG. 18

| EVENT | CAM (DEGREES) | STEPPER MOTOR (# STEPS) | CAM RADIUS (MM) |
|---|---|---|---|
| INITIALIZATION- DOWN STOP | -10 | 0 | 5.5 |
| REST POSITION | 0 | 16 | 5.5 |
| START SLED RISE | 10 | 32 | 5.5 |
| SLED FIRST AT WIPER UP POSITION | 150 | 256 | 10 |
| SLED AT WIPER UP NOMINAL POSITION | 160 | 272 | 10 |
| START SLED RISE TO CAP POSITION | 170 | 288 | 10 |
| TOGGLES START ACTUATING | 338.2761 | 557.24176 | 15.091 |
| SLED IN UP POSITION | 350 | 576 | 15.1 |
| START SLED DANCING | 350 | 576 | 15.1 |
| TOGGLES THEORETICALLY ACTUATED | 360 | 592 | 15.1 |
| START FLAPPER FOLLOWER DOWN | 360 | 592 | 15.1 |
| START FLAPPER DOWN | 367.4286 | 603.88576 | 15.1 |
| CAP UP NOMINAL MOTOR POSITION | 380.625 | 625 | 15.1 |
| FLAPPER DOWN | 534.4604 | 871.13664 | 15.1 |
| FLAPPER DOWN NOMINAL POSITION/ INITIALIZATION- UP STOP ( BOTTOM CRANK) | 560 | 912 | 15.1 |

FIG. 20A

| | SERVICE STATION STEPPER MOTOR STEPS | CARRIAGE MOTOR | HOLD TIME |
|---|---|---|---|
| START POSITION | 576 | RIGHT AT 35% PWM | 0.1 SEC |
| LEFT CARRIAGE MOVE | 576 | LEFT AT 30% PWM | 0.1 SEC |
| RIGHT CARRIAGE MOVE | 600 | RIGHT AT 27% PWM | 0.1 SEC |
| LEFT CARRIAGE MOVE | 625 | LEFT AT 25% PWM | 0.1 SEC |
| DONE | 625 | OFF | N/A |

FIG. 20B

TWO STAGE PRINT CARTRIDGE CAPPING TECHNIQUE

TECHNICAL FIELD OF THE INVENTION

This invention relates to ink-jet printing systems, and more particularly to a two-stage capping technique for capping the print head nozzles of an ink-jet pen when the pen is not printing.

BACKGROUND OF THE INVENTION

Pens used with ink-jet printing systems available today include print heads which have nozzle arrays with very small nozzles through which ink droplets are fired. The ink used with the pens typically dries quickly, permitting plain paper printing. Such pens are susceptible to nozzle clogging with dried ink or minute particles such as paper fibers.

Ink-jet printers have utilized a service station which includes a mechanism to cap the print head nozzles when the pen is not printing. Typically, the cap mechanism encloses the exposed outer surface of the orifice plate defining the nozzle array, to help prevent drying of the ink at the nozzles, and prevent contact with dust. The service station may also include a wiper mechanism for wiping away particles accumulated on the orifice plate, and a receptacle into which the pen periodically fires to purge dried or plugged nozzles.

In a multi-function office machine marketed by Hewlett-Packard Company as the 500 Series "OfficeJet," the service station includes a sled to which are affixed rubber caps to serve the capping function. A motor driven rotating cam engages the sled, when the carriage is positioned at the service station, to lift the sled and its datum surfaces into engagement with the carriage. As the datum surface engage the corresponding carriage datum surfaces, the rubber caps are brought into engagement with the nozzle arrays of the print cartridges mounted in the carriage. This arrangement is a single stage capping mechanism.

This invention provides an improved two-stage capping technique for capping the nozzle arrays of an ink-jet printing system.

SUMMARY OF THE INVENTION

A service station is described for servicing an ink-jet printhead of an ink-jet printing system, the printhead having nozzles that selectively eject ink therethrough. The service station includes a sled structure, and an elevator mechanism coupled to the sled structure for moving the sled structure between a rest position and a sled capping position. A printhead cap is supported on the sled structure, and is movable relative to the sled structure for movement between a retracted position and a printhead capping position. The cap is adapted to surround and seal the printhead nozzles when the sled has been moved to the sled capping position and the printhead cap has been moved to the printhead capping position. In an exemplary embodiment, a piston is carried by the sled structure, and the printhead cap is mounted to the piston. An actuating mechanism moves the piston from a retracted position to an extended position, wherein the printhead cap is positioned at the printhead capping position when the piston is moved to the extended position.

The sled structure includes a set of sled datum structures adapted to mate with a corresponding set of datum features formed in a printhead carriage structure when the carriage structure is positioned at the service station as the sled structure is moved from the rest position to the sled capping position. The actuating mechanism is adapted to move the piston to the extended position after the sled structure has been moved from the rest position to the sled capping position.

In accordance with a further aspect of the invention, a two-stage capping method for capping ink-jet nozzles of an ink-jet printhead carried by a carriage of an ink-jet printing system, comprising the steps of:

positioning the carriage at a service station;

in a first stage, moving a sled structure from a rest position to a sled capping position;

in a second stage, moving a printhead cap carried by the sled structure from a retracted position to a printhead capping position, the cap adapted to surround and seal the printhead nozzles when the sled has been moved to the sled capping position and the printhead cap has been moved to the printhead capping position.

The first stage further includes, in a preferred embodiment, engaging a set of sled datum structures with a corresponding set of datum features formed in the carriage to accurately locate the sled structure relative to the carriage before the printhead cap contacts the printhead nozzles. The carriage is movable along a carriage scan axis, and the first stage can optionally further include incrementally moving the carriage back and forth along the carriage scan axis about a carriage service position while the sled datum structures are being engaged with the carriage datum structures to facilitate said engaging of the sled datum structures with the carriage datum structures.

BRIEF DESCRIPTION OF THE DRAWING

These and other features and advantages of the present invention will become more apparent from the following detailed description of an exemplary embodiment thereof, as illustrated he accompanying drawings, in which:

FIG. 11 is a cross-sectional view taken along line 11—11 of FIG 2, showing a spring-loaded piston and cap.

FIG. 12 is a cross-sectional view of the piston and cap of FIG. 11, taken along line 12—12 of FIG. 11.

FIGS. 13–18 are simplified diagrammatic views illustrating the service station sled being raised into engagement with the carriage during the capping process.

FIG. 20A is a timing chart of the service station and flapper movement. FIG. 20B is a timing chart illustrating the sled dithering or dancing.

DETAILED DESCRIPTION OF THE PREFERRED EMBODIMENT

Overview of the Invention

A two-stage capping technique is described, wherein a sled structure is moved up so that sled datums mate with carriage datums and accurately locate the sled relative to the carriage first. Then the caps are actuated, and are lifted up and mate with the pen nozzle plates, sealing against the nozzle plate.

In accordance with an aspect of the invention, first and second toggles, intermated by means of involute action, push up on a retainer structure, which keeps both sides parallel during motion, and which has pistons which are spring loaded-upwardly relative to the retainer. Rubber caps are positioned on the top of the pistons, and mate with the pens to be capped.

The service station includes a double-sided cam. On the front side, the cam has a primary cam track or cam surface which lifts the sled up from a sled rest position into engagement with the carriage at a sled extended position, and lowers the sled back down to the sled rest position. The cam back side has a secondary cam surface or track which runs to the outer periphery of the cam. A "toggle" arm of the second toggle hangs down and has a follower feature which is engaged by this secondary cam track. When the sled is down, in the rest position by the front side of the cam, the follower feature of the second toggle is in a clear area on the back of the cam and is inactive, i.e. it is clear of all features of the cam and will not be engaged by the cam no matter how it is rotated. A "scoop" shape or feature on the end of the arm hits the shaft of the cam if the toggle is inadvertently stuck up which forces it into the down, retracted position. When the sled is lifted this follower feature engages with the secondary cam surface on the back of the cam when that surface rotates around, with the intent of actuating the secondary action. This raises the retainer structure, moving the pistons upwardly from the retracted position to a print-head capping position. The retainer structure has two pistons snapped into it with a precompressed spring in-between the pistons and the retainer. The top of the pistons have the rubber caps snapped onto them such that when the spring-loaded pistons are raised the caps hit the nozzle plates of the pens to be capped. The spring is then compressed, giving the desired compression.

Exemplary Embodiment

In an exemplary embodiment, the service station is employed in an ink-jet printing system comprising a multi-function office machine, which provides printing, optical scanning and other functions. One exemplary type of such a multi-function office machine to which the invention can be applied is described in application Ser. No. 08/724,297, filed Sep. 9, 1996, "Multiple-Function Printer Document Deflector Actuation Coupled to Service Station," (the '297 application) the entire contents of which are incorporated herein by this reference.

Figure 1:
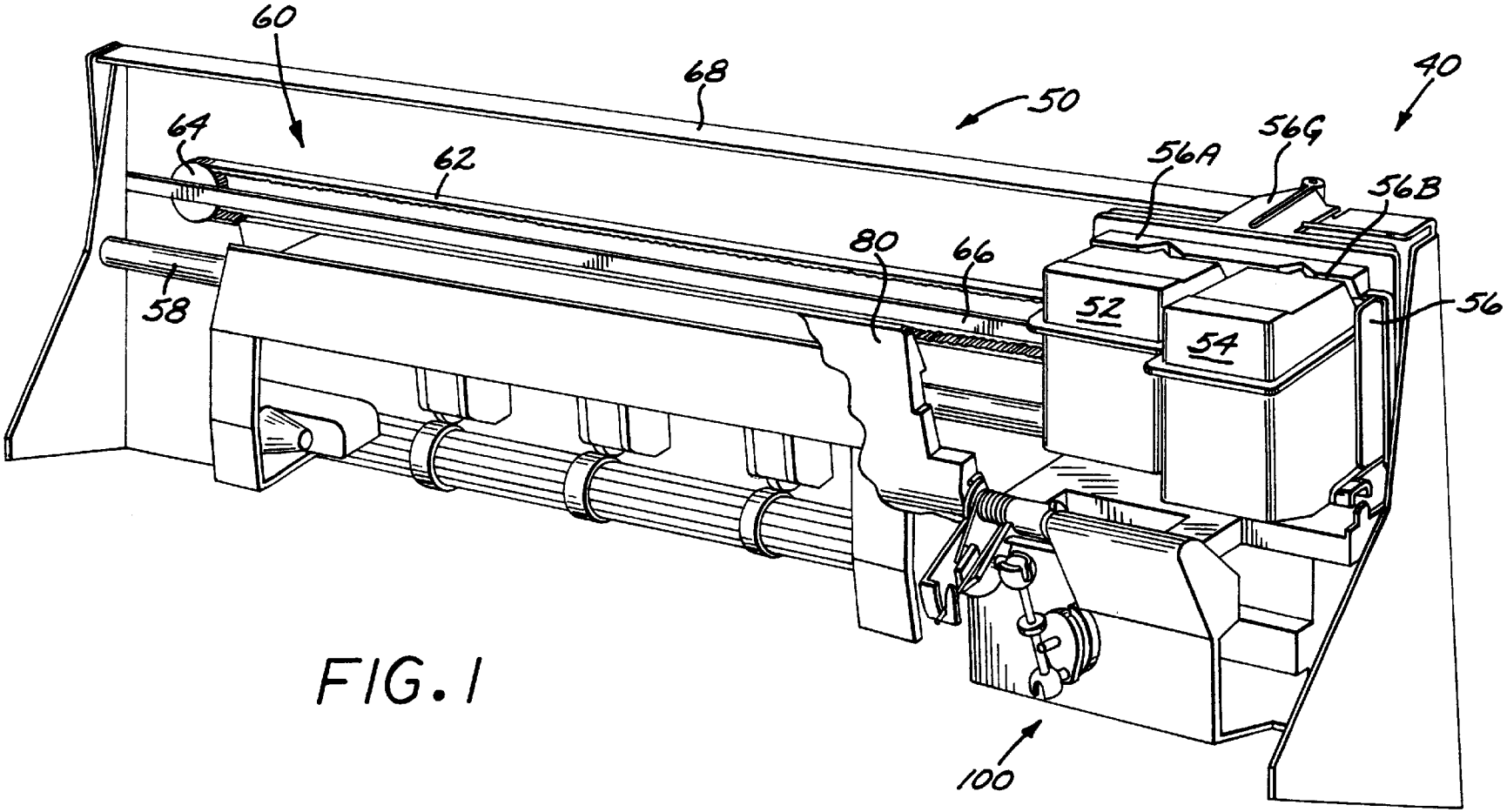
FIG. 1 is an isometric view of a portion of a multi-function office machine with an ink-jet printing system embodying the invention.

FIG. 1 is an isometric view of a portion of a multi-function office machine 40 embodying the invention. The machine includes an ink-jet printing system 50 wherein a print medium in sheet form is passed along a media path from an input tray to a print zone. Two ink-jet print cartridges or pens 52, 54 are held in a scanning carriage 56, which is movable along a scan axis. During printing, the carriage 56 is passed along the scan axis, and the print cartridges 52, 54 are selectively activated to eject droplets of ink onto the surface of the print medium. The first print cartridge 52 holds black ink. The second print cartridge 54 is a tri-compartment, tri-color pen for cyan, magenta and yellow inks.

The machine 40 includes apparatus that provides motion to the ink-jet cartridges 52, 54 and locates them in order to provide good image quality. This apparatus includes a Y or carriage scan axis drive system 60 and the carriage 56. The Y drive system provides an accurate motion to the carriage, in position and speed. The motion is provided by a motor-belt system, held at each end of the carriage slider rod 58. The drive belt 62 is driven by the motor, and is reeved about pulleys (e.g. pulley 64). The carriage 56 is secured to the drive belt, so that rotational motor movement is translated into linear motion of the carriage along the slider rod. The carriage is constrained from rotation about the slider rod 58 by a roller assembly 56G engaging a track in the frame 68.

The carriage motion speed and position are read by an optical encoder sensor mounted on the carriage, sensing lines on a linear encoder strip 66. An exemplary encoder system is described in U.S. Pat. No. 5,276,970, CODE-STRIP IN A LARGE-FORMAT, IMAGE-RELATED DEVICE, the entire contents of which are incorporated herein by this reference. Electrical signals to and from the carriage are supported by a trailing cable, which leads to the machine controller.

The machine 40 further includes a sheet deflector or "flapper" 80 which is movable to a first position to constrain the position of a document being scanned by the scanner function, or to a second position during printing functions which does not constrain the position of a medium sheet. This flapper and its function is described more fully in the referenced '297 application.

The carriage holds the removable pens 52, 54 in stalls 56A, 56B, and provides a correct position of the pens in space, i.e. relative to each other and to the paper or print medium.

The ink-jet printing system further includes a service station 100 for performing periodic servicing of the print head nozzle plates 52A, 54A (FIG. 13) comprising each cartridge 52, 54. This servicing includes wiping and capping services. The service station 100 also actuates the flapper 80 to move it to the first position while the carriage is at the service position at the station 100. In a general sense, the '297 application discloses a service station which performs wiping and capping services, and actuates a flapper. In accordance with the invention, the service station 100 provides a two-stage capping function.

FIGS. 2–18 illustrate the service station 100 in further detail. The service station includes a frame structure 102 including a back plate 104 and a side plate 106. The back plate supports a stepper motor 110 which drives both the service station actuation and the document deflector (flapper). A reduction gear 112 is coupled to a pinion mounted on the motor drive shaft, and engages the gear teeth 122 on the outer periphery of the cam 120 to rotate the cam on mounting shaft 124. The cam 120 has a raceway 128 formed on its front face 120A (FIG. 4).

Figure 2:
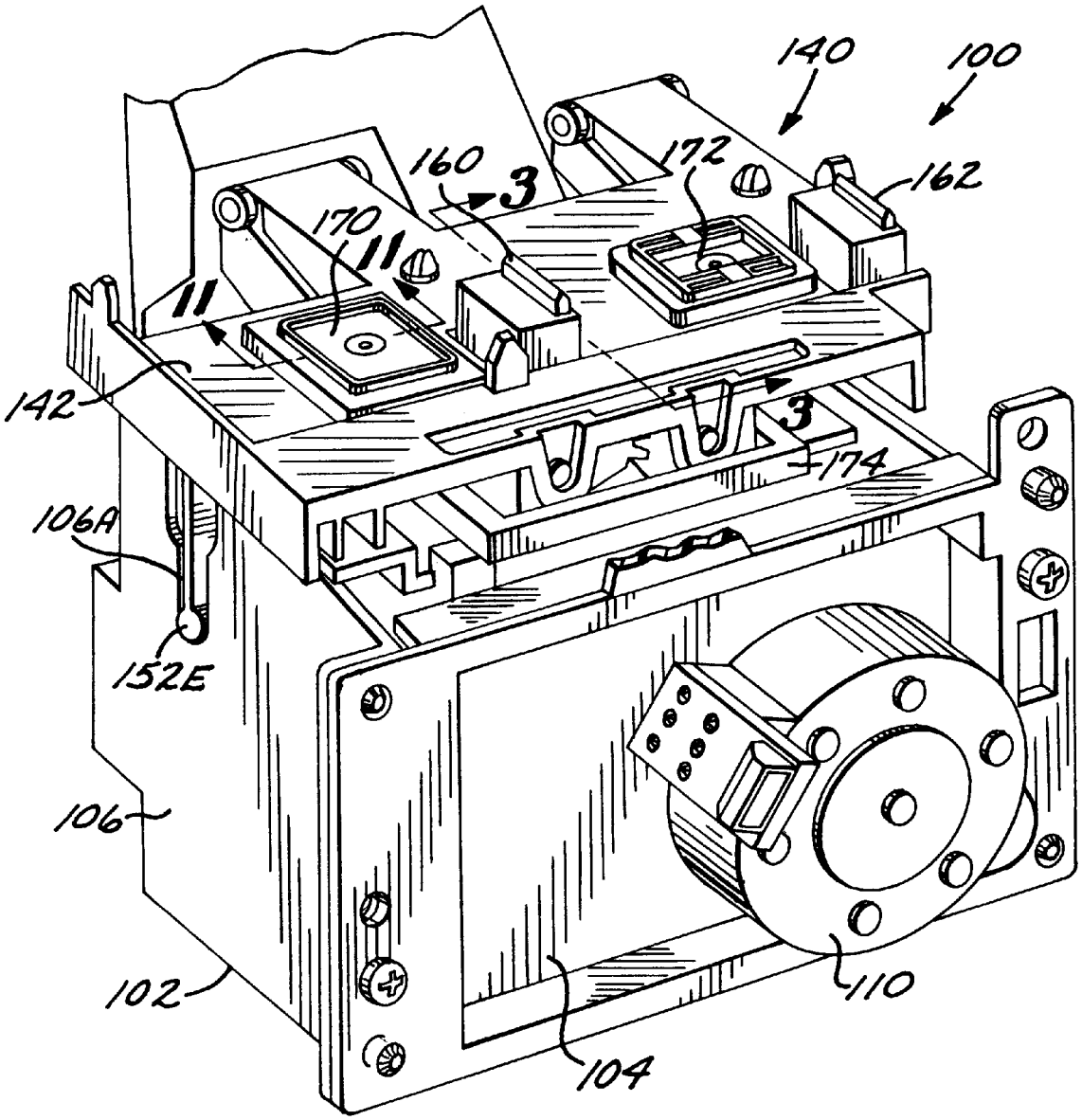
FIG. 2 is a rear isometric view of the service station of the machine of FIG. 1.
Figure 3:
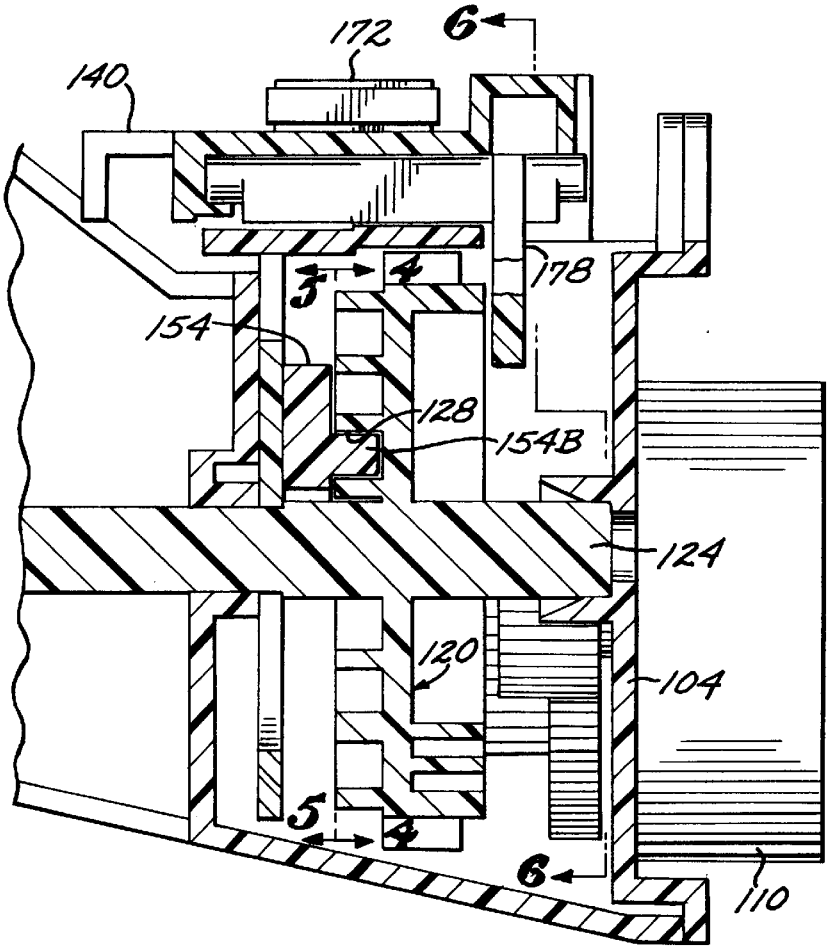
FIG. 3 is a partial cross-sectional view of the service station of FIG. 2, taken along line 3—3 of FIG. 2.
Figure 5:
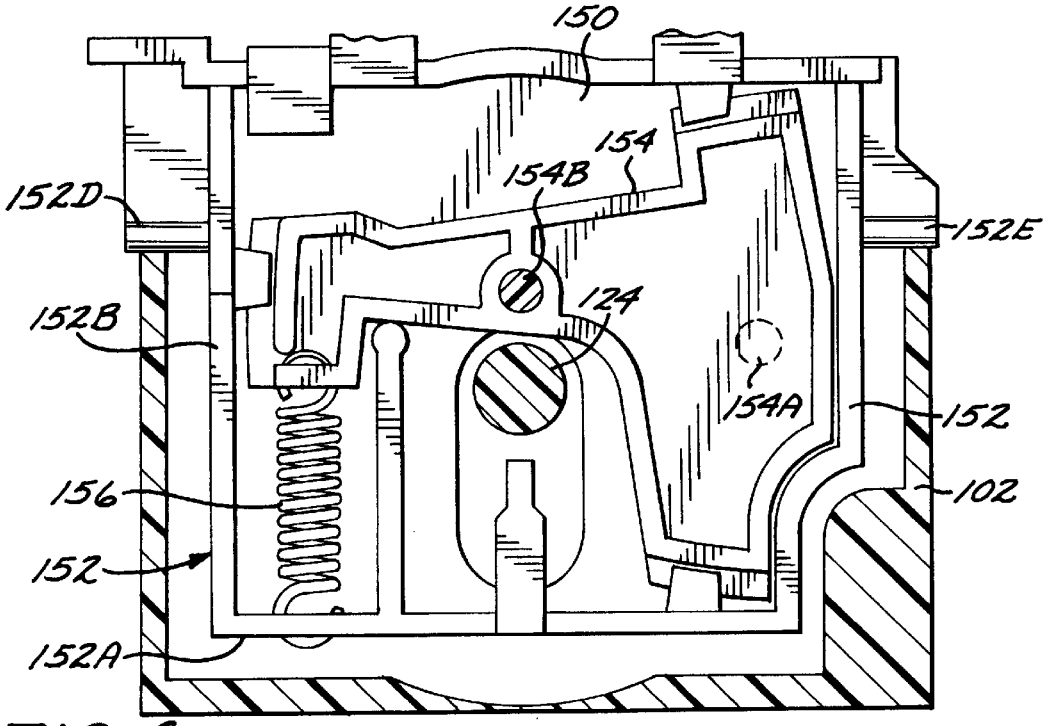
FIG. 5 is a partial cross-sectional view, taken along line 5—5 of FIG 3.

The service station 100 further includes a sled assembly 140 which is supported on a carrier assembly 150 raised and lowered by the cam 120. The carrier assembly, the cam and the motor 110 together comprise an elevator apparatus for raising and lowering the sled between the sled rest position and the sled extended position. As shown in FIG. 5, the carrier assembly includes a carrier 152, a cam follower 154 which is assembled to the carrier to pivot, at one end of the follower, about pin 154A, and a spring 156. The follower 154 has a follower pin 154B protruding from an intermediate position, which is captured in the raceway 128 of the cam 120. The spring 156 is connected between the opposite end from the pivot end of the follower 154 and the floor panel 152A of the carrier. The carrier fits within the frame structure 102 of the service station. The opposed side walls 152B, 152C have protruding therefrom bosses 152D, 152E which are fitted for sliding movement in vertically oriented slots formed in the side walls of the frame 102. For example, FIG. 2 shows boss 152E fitted into slot 106A of the side wall 106. The slots and bosses permit vertical movement of the carrier assembly 150 within the frame.

The sled assembly 140 includes the sled structure 142 which carries several elements, including spring-loaded printhead wipers 160, 162, printhead caps 170, 172, as well as other elements including a retainer structure 174, a left toggle arm 176 and a right toggle arm 178.

Figure 4:
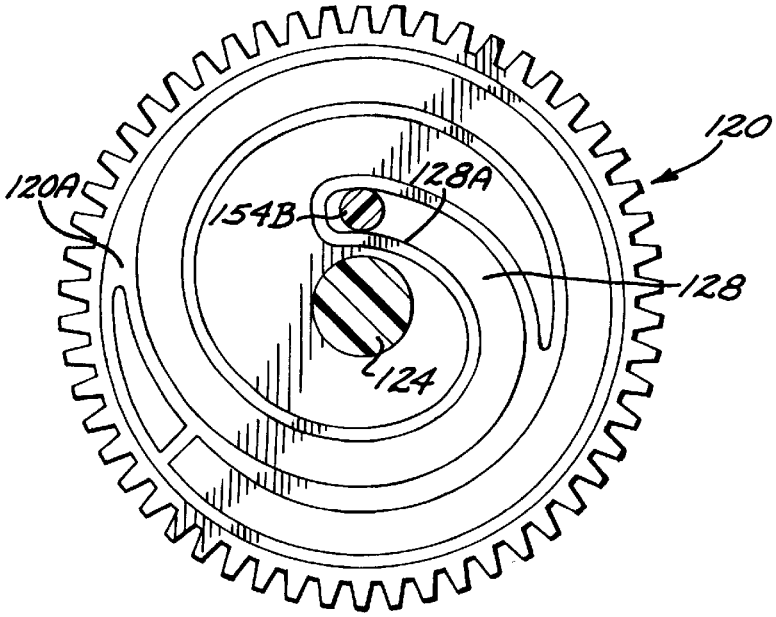
FIG. 4 is a plan view of the service station cam, taken in the direction of 4—4 of FIG. 3.

Vertical movement of the carrier assembly is accomplished by the elevator apparatus by driving the motor 110 in a direction to turn the cam 120 in a counterclockwise (CCW) direction as viewed in FIG. 4. With the pin 154B of the follower 154 captured in the raceway 128, the wall 128A forms a cam surface that will contact the pin 154B and exert an upward force thereon as the radius of the wall portion contacting the pin increases. This in turn lifts the carrier assembly 150 (and the sled assembly 140 mounted to the carrier). It will be seen that the radius of the wall 128A eventually reaches an essentially constant radius, so that the carrier assembly 150 is no longer urged upwardly by further rotation of the cam 120. This provides a dwell state of the carrier position during further cam rotation, which is used to actuate the flapper.

The service station 100 is adapted to provide some overtravel, e.g. 1 mm, of the sled assembly 140 in the absence of the carriage at the service station, i.e. the sled will be raised about 1 mm higher in the absence of the carriage than if the carriage is present. The spring 156 extends to accommodate the overtravel of the follower relative to the sled and carrier, ensuring that the sled fully mates with the carriage.

To the extent just described, the exemplary embodiment of the service station 100 operates in the same fashion as the capping and wiping system 240 described in the '297 application. In accordance with the invention, the service station 100 is adapted to provide a two-stage capping process to cap the nozzle plates of the pen cartridges when the carriage is moved to the service station.

Figure 19:
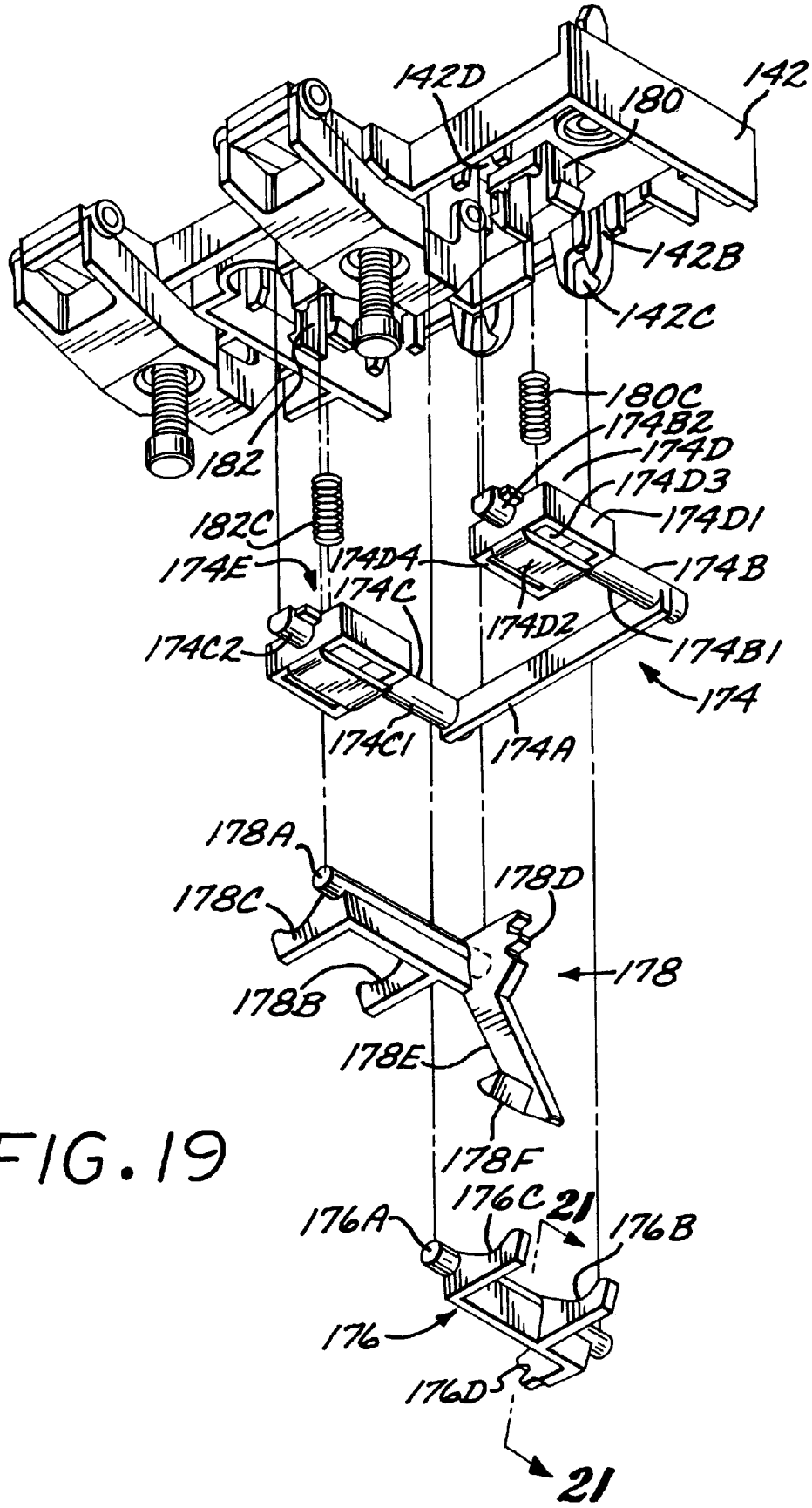
FIG. 19 is a partially exploded view of the sled assembly of the service station.

The sled assembly 140 mounted to the carrier assembly 150 includes the sled structure 142 which carries several elements, including spring-loaded printhead wipers 160, 162, printhead caps 170, 172, as well as other elements including a retainer structure 174, a left toggle arm 176 and a right toggle arm 178. FIG. 19 is a partially exploded view of the sled assembly 140 showing the retainer, 174 and the toggles 176, 178.

The caps 170, 172 are fabricated of an elastomeric material for compliant seating against the nozzle array substrate of the pen cartridges, and have a peripheral wall which surrounds and seals the printhead nozzles when the cap is seated against the nozzle plate. These caps are carried on respective piston members 180, 182 which fit within rectilinear apertures formed in the sled structure 142. FIG. 11 illustrates an exemplary aperture 142A formed in the sled structure, with piston 180 and cap 170 mounted thereon. The pistons can move up and down within a range of movement with respect to the top surface 142B of the sled structure. Opposing walls of the pistons have ridges formed therein to accurately guide the pistons upwardly and downwardly with respect to the apertures in the sled structure. The pistons are typically injection molded from an engineering plastic material. To improve the accuracy of the guiding, the ridges are formed with zero draft in an exemplary embodiment, while the walls have some draft to facilitate removal from the mold. FIG. 12 shows exemplary piston walls 180E and 180F having respective guide ridges 180H and 180I extending therefrom.

The retainer 174 is a frame structure which carries the pistons 180, 182. The retainer has a generally U-shaped configuration, formed by an intermediate bar portion 174A and transversely extending leg portions 174B, 174C. A piston support structure 174D, 174E is formed in the respective leg portions 174B, 174C. Each piston support structure, e.g. 174D, includes a rectilinear frame portion (174D1), a spring support plate portion (174D2), with open slots (174D3, 174D4) formed therein.

The pistons have barbed side members which are received and captured in the slots of the piston support structure, e.g. piston 180 has barbed side members 180A, 180B (FIG. 11) which fit through slots 174D3, 174D4, and the barb ends slide over the edges of the frame portion 174D1 to capture the piston 180. A coiled spring 180C, 182C is fitted in compression between the support plate portion of the piston support structure and the piston head. Thus, e.g., for piston 180, spring 180C is fitted between plate portion 174D2 and piston head portion 180D (FIG. 11). This spring-loads the piston head portions carrying the caps 170, 172 upwardly with respect to the retainer 174, while permitting movement of the caps with respect to the retainer as the caps are urged against the printhead nozzle plates, thereby compressing the springs.

The retainer 174 leg portions 174B, 174C are guided in sled retainer guide slots, e.g, slot 142B for leg portion 174B, which permit up/down movement of the retainer within the slots relative to the sled structure 142. The left and right toggles 176, 178 are fitted into toggle pivots formed in the sled structure 142, e.g. pivots 142C, 142D capturing axle portions, e.g. portion 178A, defined at ends of the toggles. The toggles can rotate about the pivots through a range of movement. Each toggle has a pair of arcuate arm portions defining cam surfaces which contact the retainer 174, straddling a respective piston support structure, to provide a means of raising and lowering the pistons and caps relative to the upper surface of the sled structure 142. Thus, toggle 176 has cam surfaces 176B, 176C which contact respective follower surfaces 174B1, 174B2 of the retainer leg portion 174B. Toggle 178 has cam surfaces 178B, 178C which contact respective follower surfaces 174C1, 174C2 of the retainer leg portion 174C.

The toggles 176, 178 are further formed with respective sets of involute teeth 176D, 178D which are intermated when the toggles are assembled into the sled structure 142. The toggle 178 further has a toggle arm 178E having a cam follower 178F extending therefrom at a distal end thereof.

The cam 120 has formed on its rear surface 120B a secondary cam 126 (FIG. 6) defined by wall 126A. The cam follower 178F of the toggle 178 follows this cam during rotation of the cam 120. At an abrupt change of the cam surface radius at 126C, the toggle arm 178E is actuated. When the toggle arm is actuated by the secondary cam surface 126 of the cam, the toggle 178 rotates about its pivot. The toggle 178 is intermated with the toggle 176 by means of the involute teeth 176D, 178D. This gives conjugate action as the two toggles 176, 178 rotate (in opposite directions) in a smooth and accurate fashion.

The toggle cam surfaces 176B, 176C and 178B, 178C then push up on the follower surfaces 174Bl, 174B2, 174C1, 174C2 of the retainer (two on each side for a total of four mating surfaces to guarantee parallelism) which raises the retainer 174. The intermediate bar portion 174A provides a cross linkage on the retainer 174 such that both sides of the retainer where the pistons are snapped in place are kept parallel to the sled structure 142.

Figure 21:
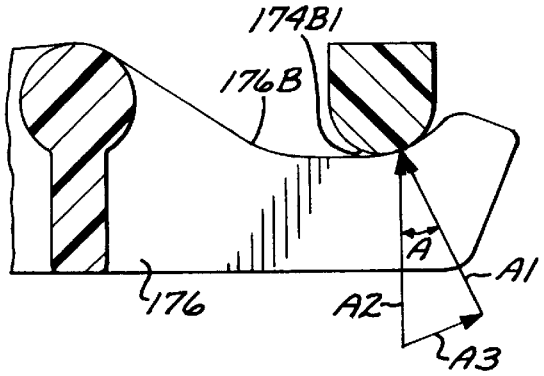
FIG. 21 is a cross-sectional view taken along line 21—21 of FIG. 19.

The shape of the toggle cam surfaces 176B, 176C and 178B, 178C is such that the angle always compensates for the sliding friction between the toggle material and the retainer material such that the resultant force vector is purely vertical during the lifting motion. The angle of compensation is the arctangent of the coefficient of friction between the toggle 176, 178 material and the retainer 174 material. The angle of compensation A is illustrated in FIG. 21, where arrow A1 is the force vector applied by and normal to the cam surface 176B at the point of contact with the retainer surface 174B1, arrow A3 indicates the force vector due to friction between the contacting surfaces, and arrow A2 indicates the desired resultant force vector in the vertical direction. In the absence of any relative sliding, arrow A1 would coincide with A2 to provide a vertical force vector. However, since the toggle is rotating about its pivot and the cam surface 176B is sliding against the retainer surface 174B1, there is a small horizontal force vector in the direction of arrow A3 due to the friction. By angling the cam surface at angle A equal to the arctangent of the coefficient of friction between the two surfaces, the small frictional horizontal force vector is exactly compensated by a horizontal force vector in the direction opposite to the direction indicated by arrow A3. By way of example, if the toggle 176 is fabricated of acetal with 20% Teflon (TM), and the retainer is fabricated of Nylon (TM) with 20% Teflon, resulting in a coefficient of friction equal to 0.07, the compensation angle is about 4 degrees.

Figure 6:
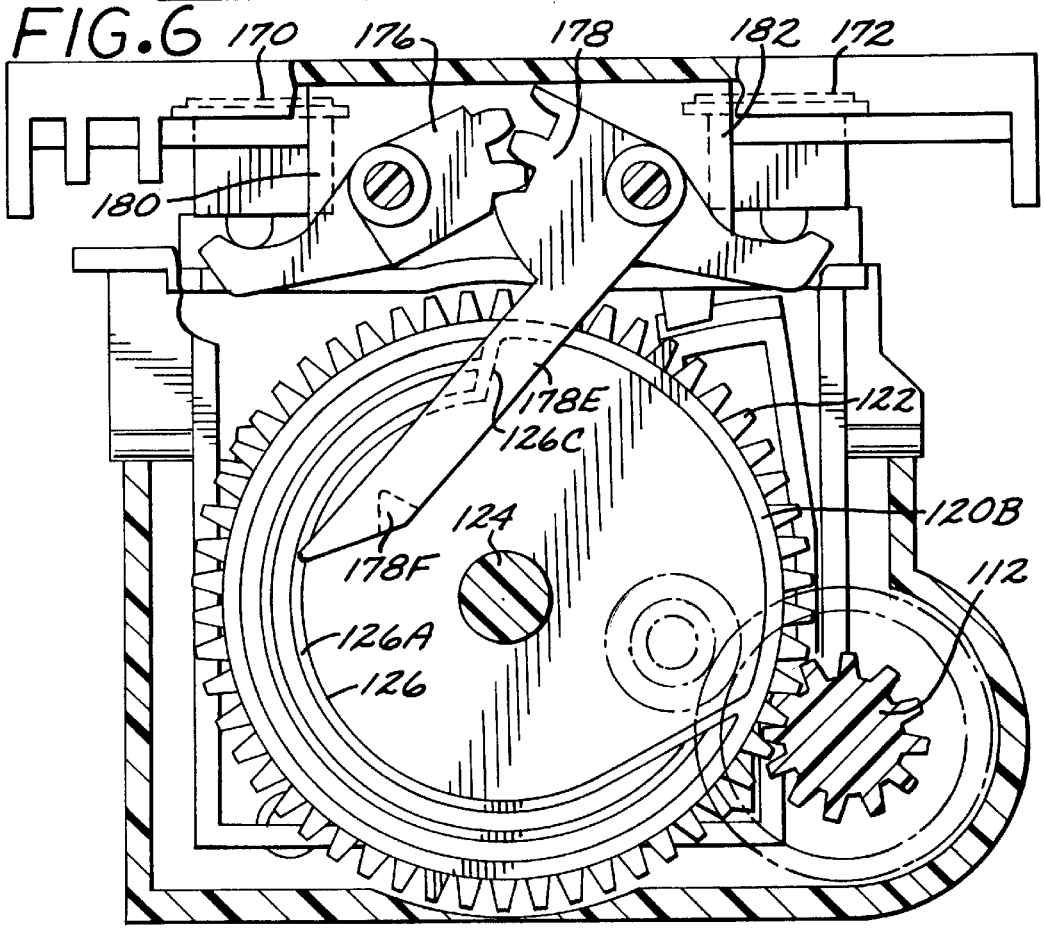
FIG. 6 is a partial side cross-sectional view taken along line 6—6 of FIG. 3, showing a cam position during the first stage of the capping process, with the sled in the down position.

FIGS. 6–10 illustrate the two-stage capping process of the service station 100. FIG. 6 shows the station with the sled assembly 140 in the fully lowered, rest position. At this sled position, the toggle follower 178F is positioned well below the secondary cam surface, and so irrespective of the angular position of the cam 120, the toggle arm will not be actuated.

Figure 7:
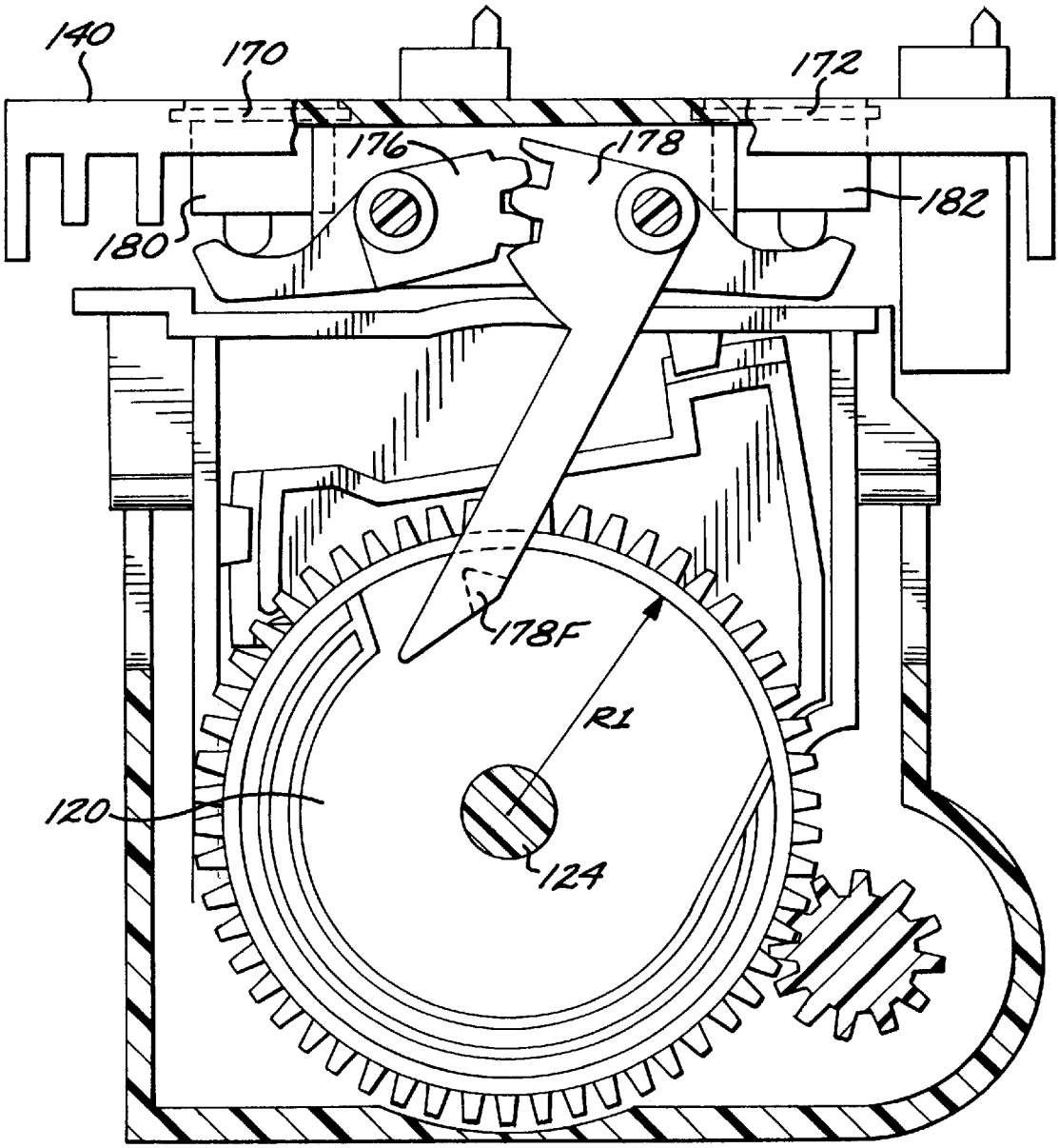
FIGS. 7–10 are cross-sectional views similar to FIG. 6, but with the cam in successive positions during the two stage capping process.
Figure 8:
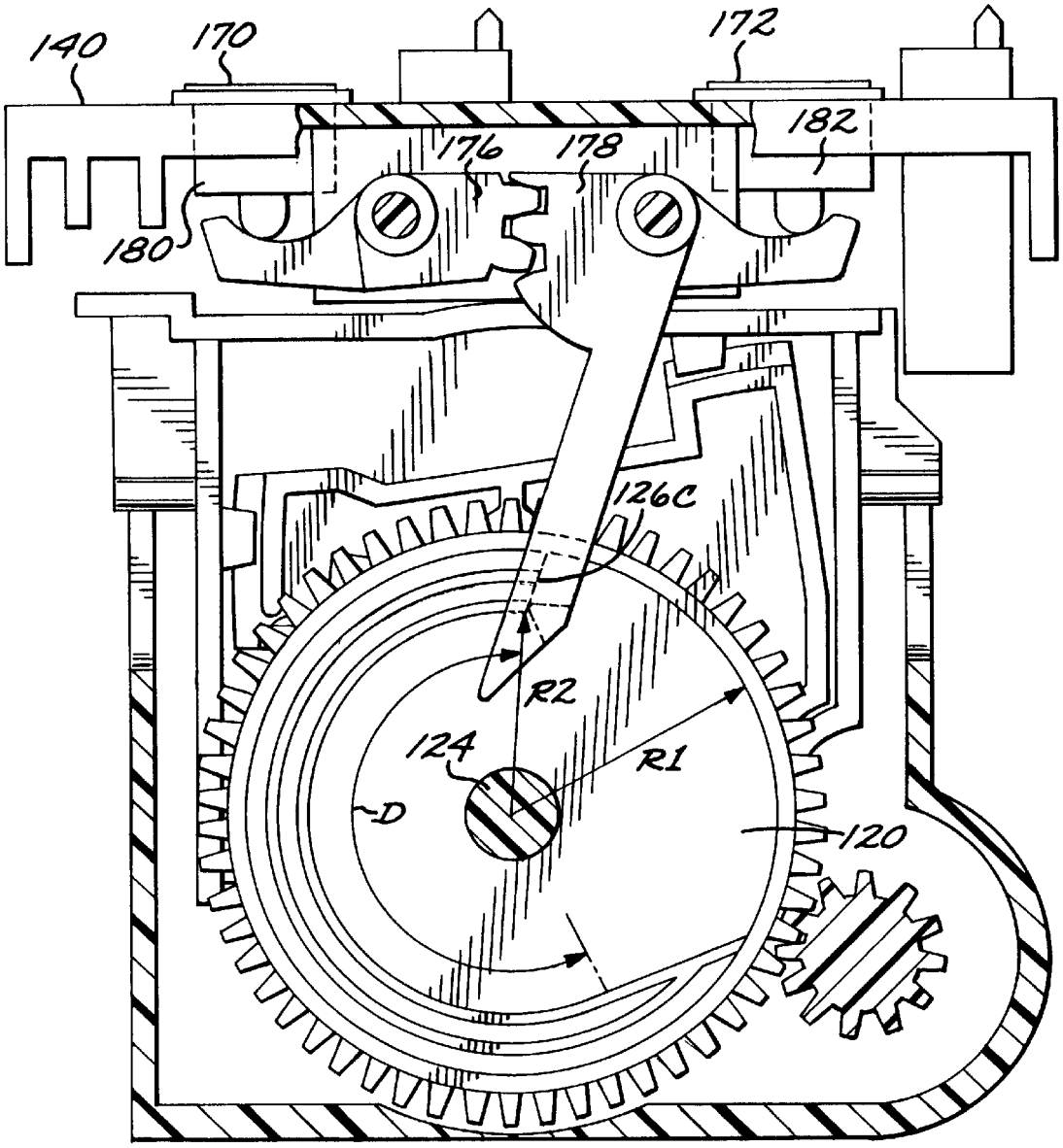

Now assume that the motor 110 has been actuated, rotating the cam 120 to raise the sled assembly in the first (sled lifting) stage of the capping process. From the perspective of FIGS. 6–10, the cam 120 is rotated clockwise (CW). The respective primary and second cam surfaces are appropriately phased in relation to one another that when the sled has been lifted, the secondary cam surface radius is at it largest size, indicated as radius R1 (FIG. 7). With this cam surface radius, the cam follower 178F is not actuated, and thus the toggles have not yet been actuated at the cycle phase illustrated in FIG. 7.

The motor 110 continues to drive the cam 120 in a CW direction. As the cam rotates, the radius of the secondary cam surface changes from R1 to a smaller radius R2 (FIG. 8), presenting a sharply angled cam surface feature 126C. This surface feature comes into contact with the toggle arm follower 178F, actuating the toggles. This actuation takes place over a relatively small angular excursion of the cam, and raises the pistons 180, 182.

Figure 9:
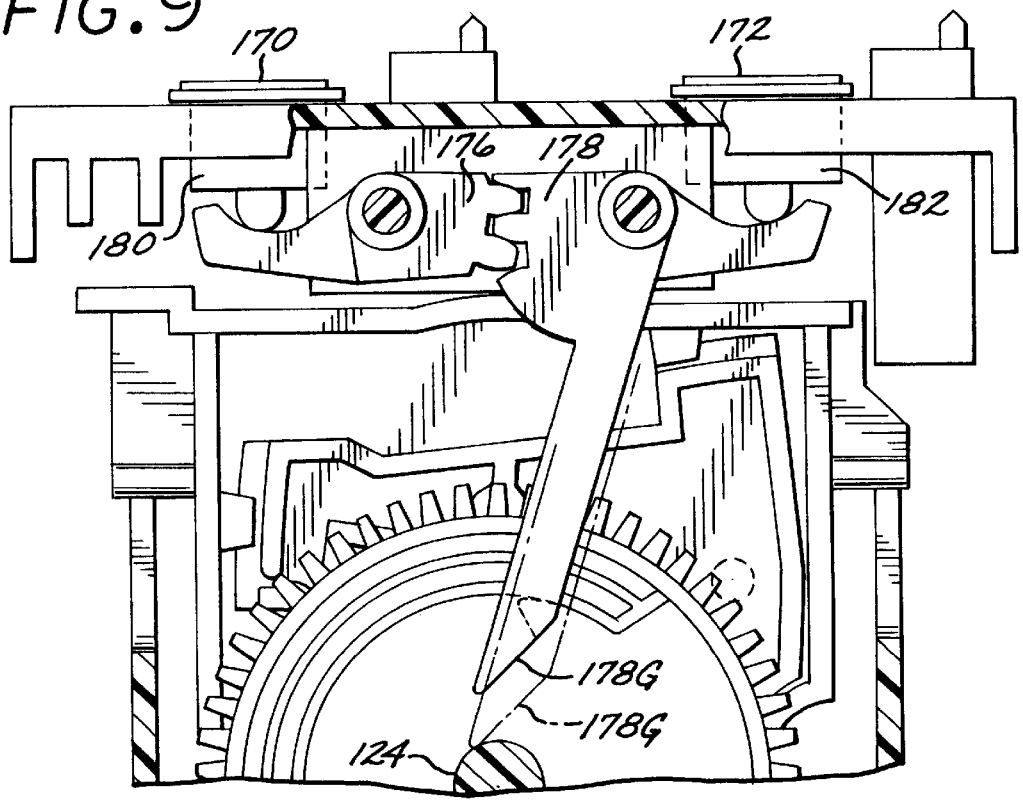
Figure 10:
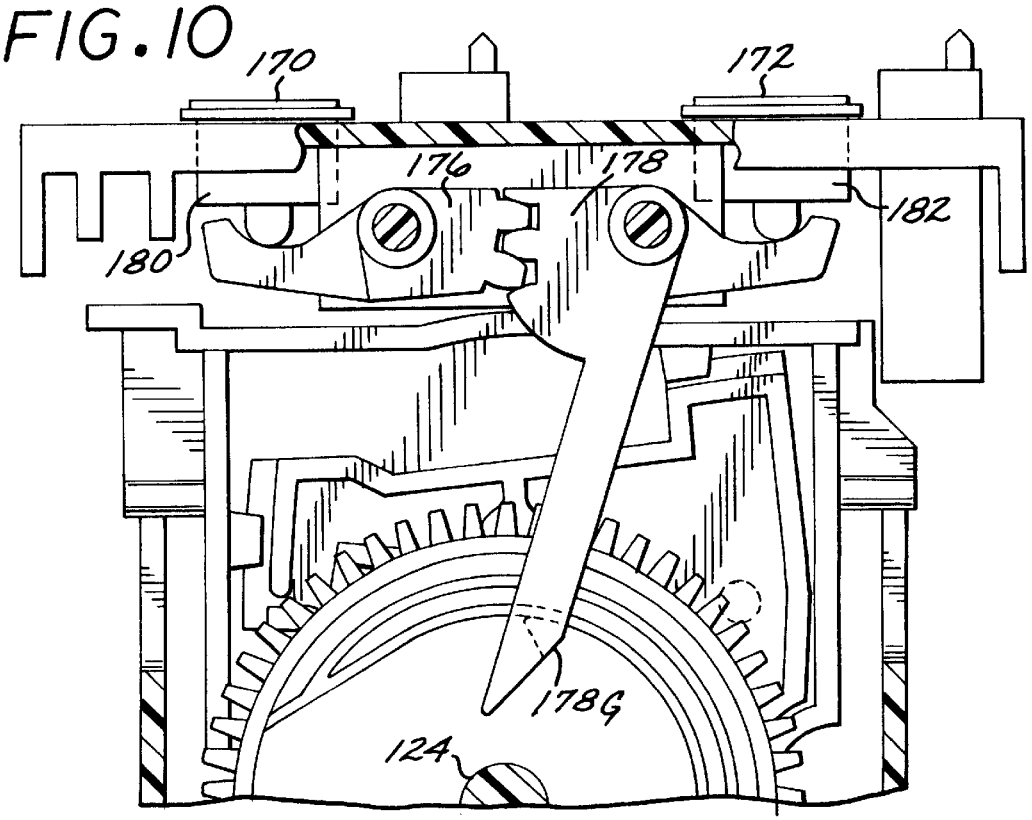

The motor continues to drive the cam 120 in the CW direction, in this exemplary embodiment, to actuate the flapper in the same manner described in the references '297 application. For this reason, the secondary cam surface 126 is provided with an exemplary dwell region D (FIG. 8), wherein the radius remains at the smaller radius R2, keeping the toggles actuated and the pistons and caps in the fully extended position, as illustrated in FIGS. 9 and 10 showing successive positions of the cam 120 and the toggle arm 178E. Once the flapper has been actuated, e.g. to the position for constraining document pages to be scanned, the motor is stopped. At this phase of the service station cycle, the carriage pens are capped, and the flapper has been moved to the scanner position.

FIGS. 13–18 are simplified diagrammatic views illustrating the stages of the capping process. Here, the carriage 56 has been moved to the service position at the service station 100 by the carriage scan drive system. The carriage holds two pen cartridges 52, 54, having respective printhead nozzle plates 52A, 54A. The sled structure includes three sled datum tabs 140C, 140D, 140E. The carriage 56 includes three corresponding datum features 56C, 56D and 56E which receive the sled datum features when the sled is raised upwardly, to register the position of the carriage and sled for proper capping of the nozzle array plates.

FIGS. 13–14 show the sled 140 in the down, rest position relative to the carriage. Now the motor 110 is actuated to start the capping process. The sled assembly 140 is raised by action of the primary cam surface. FIG. 15 shows the sled assembly in an intermediate position on its movement to the fully raised position. In accordance with another aspect of the invention, the carriage scan drive system is actuated to dither or "dance" the position of the carriage in incremental movements on either side of the service position, to facilitate engaging of the sled datums with the corresponding carriage datum features. In an exemplary embodiment, the carriage Y axis drive is driven at a given power/force level from the carriage service position for short time increments, e.g. 0.1 second, first in on direction then another, and so on. This movement is to overcome the frictions in the system; the carriage actually need not move for this dithering/dancing process to be effective. As the sled reaches its fully raised position, the dithering movement is stopped, and the datums have been engaged, as illustrated in FIGS. 16–17. After the position of the carriage and sled has been registered, as the service station motor continues to drive the cam 120, the toggles are fully actuated, lifting the retainer 174 with the pistons and caps. As the caps 170, 172 come into contact with the nozzle plates 52A, 54A, the piston springs 180C, 182C compress to resiliently urge the caps in sealing engagement against the nozzle plates. When the machine is to perform printing functions, the motor is driven in the reverse direction, turning the cam in the reversed direction to lower the sled and disengage the toggle follower from the secondary cam surface. As illustrated in FIG. 9, a "scoop" shape or angled feature 178G on the end of the toggle follower hits the shaft 124 of the cam 120 if the toggle is inadvertently stuck up which forces it into the down, retracted position.

FIG. 20A is a timing chart of the service station and flapper movement. This shows the angular position of the cam 120, the number of steps and turns of the stepper motor 110 and the secondary cam radius (relative to the follower pin 154B contact) at different stages of the capping cycle.

There is an initialization, wherein the motor is driven in the reverse direction to drive the sled against a down stop, and the motor is then driven 16 steps in the forward direction to position the cam at a start position, which is defined as 0 degrees. As shown in FIG. 20A, the toggle actuation commences at a cam position (338.2761 degrees) just in advance of the cam position (350 degrees) at which the sled is deemed to be at the sled extended (up) position. The sled "dancing" procedure is commenced at this same cam position. At the end of the sled capping procedure and after the flapper is put to the down position, the sled reaches an up stop surface.

FIG. 20B is a timing chart illustrating the sled dithering or dancing. As shown therein, this is an open loop procedure. With the carriage at the service (start) position, and with the service station motor at the position indicated, the carriage motor 65 (FIG. 22) is first driven right at 35% pulse width modulation (PWM) for 0.1 second, then left at 30% PWM for 0.1 second, then, with the motor 110 moved 24 steps, right at 27% PWM for 0.1 second, then with the motor 110 moved an additional 25 steps left again at 25% PWM, then the carriage motor drive is turned off. The application of the forces on the carriage in directions along the carriage scan axis assist is proper seating of the sled/carriage datums against frictional forces, and need not result in any actual carriage movement along the carriage axis.

Figure 22:
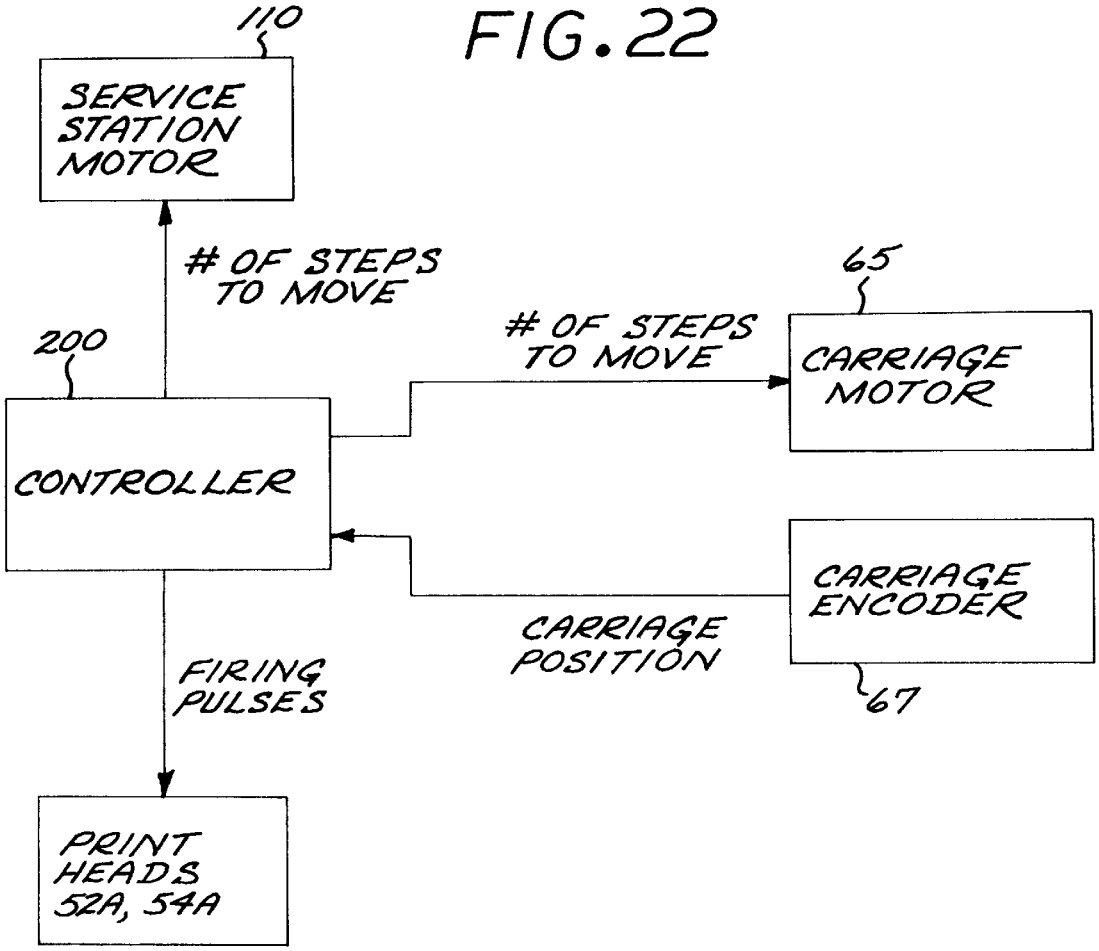
FIG. 22 is a simplified schematic block diagram of a control system for the machine of FIG. 1.

FIG. 22 is a simplified control block diagram, illustrating the machine controller 200, which provides drive commands to the service station motor 110 and the carriage motor 65, and printhead firing signals to the printheads for the cartridges 52, 54. The controller receives carriage position data from the carriage encoder 67 to keep track of the carriage position.

The advantages of the two stage capping technique include the following. A more accurate capping location is ensured by the technique. On some known ink-jet printing systems, the caps touch the pens before the location features are fully engaged into the carriage. Even as the sled is forced into the correct location, the caps have to squeegee over into the correct location. Due to the flexibility of the rubber caps and the clearance between all the parts, the actual seal against the pen never fully gets moved to the desired final position. Most carriages attempt to have sufficient lead-in to minimize this misalignment during mating of the cap surfaces, however due to necessary clearance the final position of the sled is not complete until it is fully seated into the carriage.

It is known to utilize spring loaded caps. The advantages of the two-stage capping technique of this invention include the fact that a simple spring loaded cap takes up more room in both overall height and in travel to seat the sled and compress the cap spring. Moreover, the pretravel compression of the cap spring has to occur before the sled is seated into the carriage. This not only increases the height, but leads to inaccuracies, for now the sled has to have accurate sliding lead-ins for that whole compression length and seating distance of the sled to the carriage. In accordance with the two stage capping of this invention, the sled is fully seated and accurately located into the carriage before the pistons/caps, which are accurately guided in the sled, are lifted up into engagement with the nozzle plates of the pens. The sled needs to "float" some amount to take up tolerances, i.e. to comply with any irregularities of parts and fits within some expected range of tolerances. This seating of the sled fully takes up those tolerances before the caps are raised into engagement against the nozzle plates.

Another advantage of the two-stage capping technique is that the compressive force input from the cam on the second stage of the capping process is distributed over a broader cycle than during single stage capping, since the rubber cap and the override spring in the sled assembly are all being compressed at the same time. This results in higher peak torques on the service station motor. In contrast, in the two stage capping technique, the total compressive energy is the same, but is distributed over more travel of the cam, so that the peak forces are lower.

Two-stage capping in accordance with the invention provides a vertical gain, i.e. less vertical height is required to accomplish the two functions of seating the sled and capping the pens. This is analogous to a two stage hydraulic cylinder where more stroke is obtained for a given package size.

Since the second capping stage is sprung relative to the sled, and the sled is fully seated before the actuation of the caps, the springs 180C, 182C provide independent suspensions for the two piston/cap assemblies. That is, the capping force and location accuracy are not dependent on the existence, type or condition of the pen in the other stall of the carriage. This "independent suspension" also gives it better planarity compensation than a regular cap design which depends on the seating of the sled datums into the carriage, and then the physical interference of the rubber determines the seal. For a simple spring-loaded cap, the capping actions are not independent for the cap spring is being compressed before the sled is seated and therefore biasing the sled differently depending on the state of the opposite pen stall.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A service station for servicing an ink-jet printhead of an ink-jet printing system, the printhead having nozzles that selectively eject ink therethrough, comprising:

a sled structure;

an elevator mechanism coupled to the sled structure for moving the sled structure between a rest position and a sled extended position;

a printhead cap supported on said sled structure and movable relative to the sled structure for movement between a retracted position and a printhead capping position, said cap adapted to surround and seal the printhead nozzles when said sled has been moved to said sled extended position and said printhead cap has been moved to the printhead capping position; and an actuating mechanism for providing relative motion between the sled structure and the printhead cap to move the printhead cap from the retracted position to the printhead capping position.

2. The service station of claim 1 further including a piston carried by the sled structure, said printhead cap mounted to said piston, and wherein actuating mechanism is adapted to move the piston from a retracted position to an extended position, wherein said printhead cap is positioned at said printhead capping position when the piston is moved to said extended position.

3. The service station of claim 1 wherein said sled structure includes a set of sled datum structures adapted to mate with a corresponding set of datum features formed in a printhead carriage structure when said carriage structure is positioned at said service station as said sled structure is moved from said rest position to said sled extended position.

4. The service station of claim 3 wherein said actuating mechanism is adapted to move said printhead cap to said printhead capping position after said sled structure has been moved from said rest position to said sled extended position and said sled datum structures have been engaged in said datum features of said printhead carriage structure.

5. The service station of claim 1 wherein said printhead cap is coupled to said actuator mechanism by a spring bias structure.

6. The service station of claim 1 wherein said actuator mechanism includes a toggle member mounted for pivoting movement about a pivot, said toggle member having a first contact surface, an actuating member for imparting rotational force to the toggle member to cause said pivoting movement, and said printhead cap is supported on a structure having a second contact surface, wherein said first contact surface engages said second contact surface at a compensation angle with respect to a direction of movement of said printhead cap, said compensation angle adapted to compensate for frictional forces imparted as a result of friction between said first and second surfaces.

7. The service station of claim 6 wherein the engagement of the first contact surface and the second contact surface is characterized by a coefficient of friction, and said compensation angle is the arctangent of said coefficient of friction.

8. A service station for servicing first and second ink-jet printheads mounted in a scanning carriage of an ink-jet printing system, the printheads having nozzles that selectively eject ink therethrough, comprising:

a sled structure;

an elevator mechanism coupled to the sled structure for moving the sled structure between a rest position and a sled extended position;

first and second printhead caps supported on said sled structure and movable relative to the sled structure for movement between a retracted position and a printhead capping position, said caps adapted to surround and seal the printhead nozzles of a corresponding printhead when said sled has been moved to said sled extended position and said printhead cap has been moved to the printhead capping position;

first and second piston structures on which are respectively mounted said first and second printhead caps, said piston structures arranged for sliding movement transverse to a sled surface;

a retainer structure supporting said first and second piston structures;

an actuating mechanism for moving the retainer structure and thereby said piston structures and said printhead caps relative to the sled structure to move said first and second printhead caps from the retracted position to the printhead capping position.

9. The service station of claim 8 wherein said first and second piston structures are independently suspended by respective spring members relative to the retainer structure, and wherein said spring members are compressible to provide proper compressive force between said printhead caps and respective printhead nozzle plates when said printhead caps seal said nozzles.

10. A two-stage capping method for capping ink-jet nozzles of an ink-jet printhead carried by a carriage of an ink-jet printing system, the carriage movable along a carriage scan axis, the printhead having nozzles that selectively eject ink therethrough, comprising the steps of:

positioning the carriage at a service station;

in a first stage, moving a sled structure from a rest position to a sled capping position and engaging a set of sled datum structures with a corresponding set of datum features formed in said carriage to accurately locate the sled structure relative to the carriage before the printhead cap seals said printhead nozzles, and applying carriage drive forces to move the carriage back and forth along the carriage scan axis about a carriage service position to facilitate said engaging of said sled datum structures with said carriage datum structures;

in a second stage, providing relative movement between said sled structure and a printhead cap carried by said sled structure to move the printhead cap from a retracted position to a printhead capping position, said cap adapted to surround and seal the printhead nozzles when said sled has been moved to said sled capping position and said printhead cap has been moved to the printhead capping position.

11. The method of claim 10 wherein said second stage includes engaging a printhead nozzle plate with said printhead cap when the cap is in the printhead capping position.

12. The method of claim 11 further comprising the step of mounting the printhead cap on a spring-loaded piston including a spring member, wherein said step of engaging the printhead nozzle plate with the printhead cap further includes compressing said spring to provide a desired compression between the cap and the nozzle plate.

13. A service station for servicing an ink-jet printhead of an ink-jet printing system, the printhead having nozzles that selectively eject ink therethrough, comprising:

a sled structure;

an elevator mechanism coupled to the sled structure for moving the sled structure between a rest position and a sled extended position;

a printhead cap supported on said sled structure and movable relative to the sled structure for movement between a retracted position and a printhead capping position, said cap adapted to surround and seal the printhead nozzles when said sled has been moved to said sled extended position and said printhead cap has been moved to the printhead capping position;

an actuating mechanism for moving the printhead cap from the retracted position to the printhead capping position; and wherein said elevator mechanism includes a motor, a gear drive, a rotatable cam driven through the gear drive, a primary cam track located on a first cam surface, and a primary cam follower engaging the primary cam track and adapted to transfer force to the sled structure, and wherein said actuator mechanism includes a secondary cam track located on a second cam surface of said rotatable cam, a secondary cam follower engagable with the secondary cam track and adapted to transfer force to a retainer structure supporting the printhead cap.

14. The service station of claim 13 wherein said secondary cam follower is connected to a toggle arm which is rotated in a first direction by said secondary cam follower when engaged by said secondary cam track to move said retainer structure in a second direction to position the printhead cap at the printhead capping position, said toggle arm having a deflector surface for contacting a stop surface when said sled structure is moved from said sled extended position toward said sled rest position to rotate said toggle arm in a third direction opposite said first direction to ensure retraction of said printhead cap from said capping position to said retracted position.

15. A service station for servicing first and second ink-jet printheads mounted in a scanning carriage of an ink-jet printing system, the printheads having nozzles that selectively eject ink therethrough, comprising:

a sled structure;

an elevator mechanism coupled to the sled structure for moving the sled structure between a rest position and a sled extended position;

first and second printhead caps supported on said sled structure and movable relative to the sled structure for movement between a retracted position and a printhead capping position, said caps adapted to surround and seal the printhead nozzles of a corresponding printhead when said sled has been moved to said sled extended position and said printhead cap has been moved to the printhead capping position;

first and second piston structures on which are respectively mounted said first and second printhead caps, said piston structures arranged for sliding movement transverse to a sled surface;

a retainer structure supporting said first and second piston structures;

an actuating mechanism for moving the retainer structure and thereby said pistons structures and said printhead caps to move said first and second printhead caps from the retracted position to the printhead capping position, said actuating mechanism including first and second pivoted toggles intermated by involute teeth, said first and second toggles including respective contact surfaces for contacting said retainer structure as said toggles are pivoted.

16. A service station for servicing an ink-jet printhead mounted in a scanning carriage of an ink-jet printing system, the printhead having nozzles that selectively eject ink therethrough, comprising:

a sled structure having a sled datum structure adapted for mating with a corresponding carriage datum structure;

a first actuating mechanism coupled to the sled structure for moving the sled structure between a rest position and a sled extended position to position the sled relative to the scanning carriage during a servicing mode when the scanning carriage is positioned at the service station, such that the sled datum structure mates with the carriage datum structure to accurately locate the sled relative to the carriage;

a printhead cap supported on said sled structure and movable relative to the sled structure for movement between a retracted position and a printhead capping position, said cap adapted to surround and seal the printhead nozzles after said sled has been moved to said sled extended position as said printhead cap has been moved to the printhead capping position; and a second actuating mechanism for providing relative motion between the sled structure and the printhead cap to move the printhead cap from the retracted position to the printhead capping position.

17. An ink-jet printing system, comprising:

a scanning carriage having a carriage datum structure;

an ink-jet printhead mounted in the carriage, the printhead having nozzles that selectively eject ink therethrough;

a service station for servicing the printhead, comprising:

a sled structure having a sled datum structure adapted for mating with the carriage datum structure;

a first actuating mechanism coupled to the sled structure for moving the sled structure between a rest position and a sled extended position to position the sled relative to the scanning carriage during a servicing mode when the scanning carriage is positioned at the service station, such that the sled datum structure mates with the carriage datum structure to accurately locate the sled relative to the carriage;

a printhead cap supported on said sled structure and movable relative to the sled structure for movement between a retracted position and a printhead capping position, said cap adapted to surround and seal the printhead nozzles after said sled has been moved to said sled extended position as said printhead cap has been moved to the printhead capping position; and a second actuating mechanism for providing relative motion between the sled structure and the printhead cap to move the printhead cap from the retracted position to the printhead capping position.

18. A method for capping ink-jet nozzles of an ink-jet printhead carried by a carriage of an ink-jet printing system, the carriage movable along a carriage scan axis, the printhead having nozzles that selectively eject ink therethrough, comprising the steps of:

positioning the carriage at a service station;

moving a sled structure from a rest position to a sled capping position wherein a sled datum structure engages a corresponding carriage datum structure on the carriage to accurately locate the sled relative to the carriage;

providing relative movement between said sled structure and a printhead cap carried by said sled structure to move the printhead cap from a retracted position to a printhead capping position, said cap adapted to surround and seal the printhead nozzles when said sled has been moved to said sled capping position and accurately located relative to the carriage and when said printhead cap has been moved to the printhead capping position;

applying carriage drive forces to the carriage to incrementally move the carriage back and forth along the carriage scan axis about a carriage service position as the sled is being moved to facilitate said engaging of said sled datum structures with said carriage datum structures.

* * * * *